US005492548A

United States Patent [19]

Wasikowski

[11] Patent Number: 5,492,548

[45] Date of Patent: Feb. 20, 1996

[54] ROUGH EDGED REFINER PLATE CUTTER BARS

[75] Inventor: Paul Wasikowski, Cudahy, Wis.

[73] Assignee: J & L Plate, Inc., Waukesha, Wis.

[21] Appl. No.: 860,984

[22] Filed: Mar. 31, 1992

[51] Int. Cl.[6] ..... B24D 3/00

[52] U.S. Cl. ..... 51/293; 51/295; 51/307; 51/308; 51/309

[58] Field of Search ..... 51/293, 295, 307, 51/308, 309

[56] References Cited

U.S. PATENT DOCUMENTS

| | | | |
|---|---|---|---|
| 4,351,489 | 9/1982 | Laptev et al. | 241/261.3 |
| 4,372,495 | 2/1983 | Marton et al. | 241/28 |
| 4,423,845 | 1/1984 | Frazier et al. | 241/261.3 |
| 4,523,930 | 6/1985 | Williston | 51/293 |
| 4,539,017 | 9/1985 | Augustin | 51/293 |
| 4,592,141 | 6/1986 | Levine | 30/138 |
| 4,653,373 | 3/1987 | Gerber | 83/697 |
| 4,681,600 | 7/1987 | Rhoades et al. | 51/293 |
| 4,745,254 | 5/1988 | Funk | 219/76.15 |

*Primary Examiner*—Shrive Beck
*Assistant Examiner*—Willie J. Thompson
*Attorney, Agent, or Firm*—Willis B. Swartwout, III

[57] ABSTRACT

A method for integrally applying a rough surface to the grooves of paper pulp refiner plates which involves placing the pattern for the plate into a mold and then applying to the desired surfaces of the pattern a mixture including a selected kind of ceramic particles with silica sand, additives and a binder system. The mold is then packed with conventional molding sand. The pattern is removed from the mold and superheated refiner plate base metal is introduced into the mold resulting in penetration of the voids around the particles and adherence of the particles to the surfaces selected by the application of the mixture. Surfaces desired to be smooth may be treated after the pattern is removed from the mold and before pouring by treating the desired surfaces with coating to accomplish that purpose. Ceramic particles used include alumina, silica, zirconia, silicon carbide, tungsten carbide, vanadium carbide and niobium carbide. These have the angularity to create the required voids to fill with molten metal.

8 Claims, 2 Drawing Sheets

ROUGH EDGED REFINER PLATE CUTTER BARS

BACKGROUND OF THE INVENTION

The present invention relates to the improvement of cutter bars for refiner plates used in the processing of paper pulp from wood.

Paper pulp is fed through grooves of a refiner plate as the result of centrifugal force created by the spinning discs to which the refiner plates are attached. The discs spin at speeds of 1200 to 2400 RPMs forcing the pulp slurry through the grooves between the bars. The pulp slurry is a mixture of wood fibre, water, chemicals and any foreign matter entrained in the fibre.

The movement of the pulp slurry through the channels or grooves between the cutter bars is controlled by a plurality of factors including;

a) the friction of the bar/groove, b) the size and number of groove openings, c) the number and placement of groove restrictions sometimes called dams; and d) the flow of steam generated in the refiner.

The flow of the steam competes with the pulp for the open flow areas. As pulp passes through the grooves of a refiner plate cutter bar it must be raised up to the refiner bar edge to promote fibrilization of the fibre to develop desired properties. Two actions are at work during the fibrilization process. The first is the stapling of the wood fibres over the leading edge of the refiner plate bar and the second is the rubbing against each other of fibres stapled to the leading edge of the cutter bars of the opposing refiner plates.

Use of abrasive materials in the refiner action stabilizes the operation improving pulp retention for better refining results and pulp quality, and also reduces energy consumption.

Abrasives also aid in improving refiner plate design because they reduce the amount of dams required to control pulp and steam flow thereby improving the handling of steam. Steam is generated by the applied energy heating the water in the pulp slurry. This steam must be released by a flow to the outside circumference of the refiner plate or toward the hub into the feed area. Whichever choice is exercised for the release of the steam, the dams for controlling the flow of the pulp slurry impedes the flow of steam, therefore the ability to reduce the number of dams is very important to the economics of energy use and consumption.

Thermal mechanical pulping (TMP) is one method of producing pulp. This method involves a plurality of stages of fibre reduction. The initial stage involves chips between one-quarter and one inch in diameter but in subsequent stages of the process wood fibre in a hot slurry is acted upon by refiner plates having refiner bars or cutter bars and dams which are finer than in the initial stage. Secondary and subsequent stages involve a slurry with a greater water content which in turn causes greater steam generation. Designs for refiner plates or refiner plate segments are more difficult to produce for secondary and subsequent stages of the refining process in the casting operation. As previously explained a tremendous amount of energy is required to drive the refiner plates in the secondary and subsequent stages because of the condition of the slurry at that stage and because of the steam. Often that energy cost is the greatest single cost factor in the pulp refining operation and the ability to control and reduce the cost of energy is most important.

The ability to retain the pulp slurry fibre in the refiner plate while at the same time reducing the number of dams required thereby promoting the exiting of the steam becomes a paramount consideration in the pulping industry. Abrasives have been found to be effective in this area by fibre engagement but there are problems in accomplishing the casting or molding of the abrasives into the refiner plate cutting bar areas as the spray coating process used to accomplish this were subject to short life due to consumption or premature removal during the operation or both.

SUMMARY OF THE INVENTION

The present invention proposes to overcome the problems of the prior art above described by providing an integral method for bonding an abrasive to the grooves of a refiner plate or refiner plate segment such that the wear and consumption of the abrasive is limited to the wear of the base material of the surface.

It is an object of the present invention to provide in the method above described to provide various textures of abrasive surfaces as may be required by the stage of pulp fibre refinement by integrating a grit size and type of abrasive into the surfaces of the refiner plate grooves.

It is another object of the present invention to provide in the method above described the integrating of types of abrasive grit in grit sizes in the range of 50 to 150 grit into the groove surfaces and grit type and size as desired for the location within the grooves of the refiner plate or plate segment.

It is a further object of the present invention to provide in the method above described abrasives chosen from a group including but not necessarily limited to alumina, zirconia, silicon carbide and other alloy carbides, the choice being dependent upon the abrasive hardness and angularity desired.

It is still another object of the present invention to provide in the method above described the method of abrasive attachment wherein the abrasive selected is introduced into the mold sand surface which will form the grooves of the refiner plate or plate segment when the mold is poured prior to the pouring and then introducing the molten metal into the mold at temperatures sufficient to penetrate the abrasive particles causing adherence and causing fluxing of the abrasive materials.

It is yet another object of the present invention to provide in the method above described the introduction of the selected abrasive into the mold sand surfaces which will form the refiner plate or segment grooves by mixing the abrasive particles with a binder such as a phenolic urethane to cause grain bonding, the abrasive then backed up with a molding sand mixture selected from the group including but not limited to silica sand, iron oxide, binder and other possible additives, which may, after the sand is cured be drawn away from the pattern exposing the abrasive material.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

Figure 4:
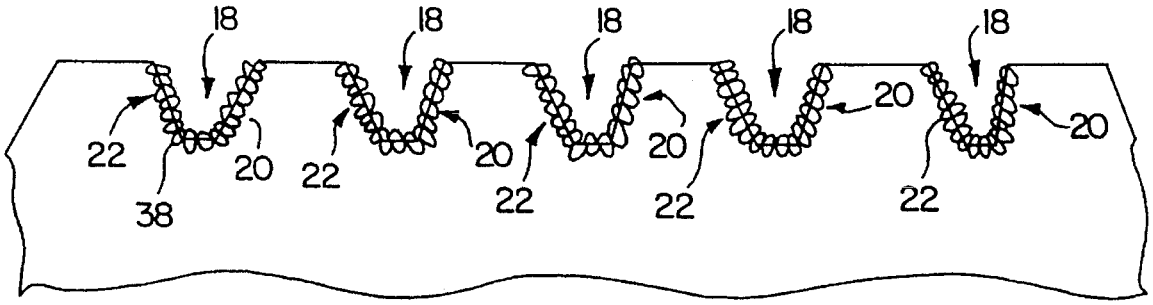
FIG. 4 is a fragmentary vertical cross-sectional view through a portion of a refiner plate or plate segment molded according to the present invention.

"It may be desirable to smooth certain surfaces such as the upwardly facing surface sections of the mold between grooves 18 as shown in FIG. 4 of the drawings. To do this a coating is applied consisting of a carrier such as water or alcohol containing one or more alloy powders such as titanium, boron, carbon, vanadium, chromium, niobium, tungsten, molybdenum or cobalt or the like by such a process as brushing, spraying, swabbing or flow coating and then drying."

DESCRIPTION OF THE PREFERRED EMBODIMENT

Prior to embarking on the description of the drawings it is well to understand that in the pulp processing operation, often referred to as a comminuting process, a plurality of refiner discs are used which are generally circular and mounted to a central hub for rotation thereon or therewith. The refiner discs could have refiner plate surfaces with cutter bars and dams but the more likely structure today involves a plurality of arcuate refiner plate segments secured to the disc such as by machine screws or bolts appropriately counter-sunk and fitted into threaded apertures provided to receive them. A sufficient number of the segments are affixed to the disc to form a full circle. Each such plate has a cutter bar and dam pattern which includes grooves between the bars and raised dams the height of the bars. Into these grooves the pulp slurry flows and it should be further understood the one or more discs having these plates are axially spacially arranged such that the bar and dam surfaces of two adjacent discs face each other but are spaced to permit the raised bar surfaces and dam surfaces from actually touching each other as they revolve.

Figure 1:
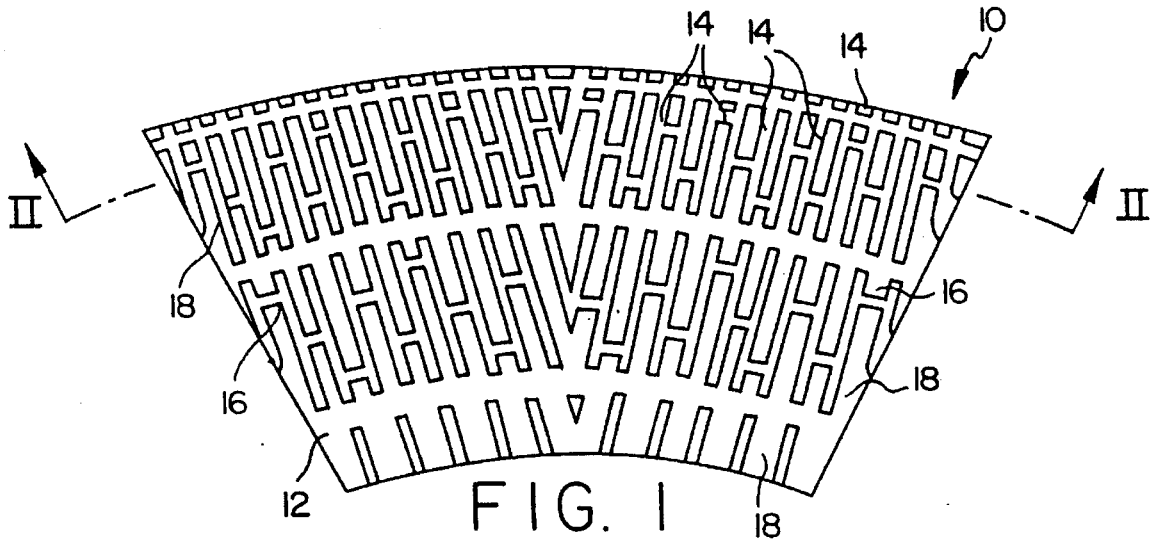
FIG. 1 is a top plan view of an arcuate segment of a refiner plate of a well known design.

Referring now to the drawings and particularly to FIG. 1 thereof a refiner plate arcuate segment is disclosed and generally identified by the numeral 10. Segment 10 includes a base 12 from which there are cutter bars, generally identified by the numeral 14, extending perpendicular to base 12. Spaced about the segment 10 are dams 16 between bars 14 and generally perpendicular to both bars 14 and base 12. The bars 14 and the dams 16 define grooves 18 through which the slurry (not shown) containing wood pulp fibres flows.

Figure 2:
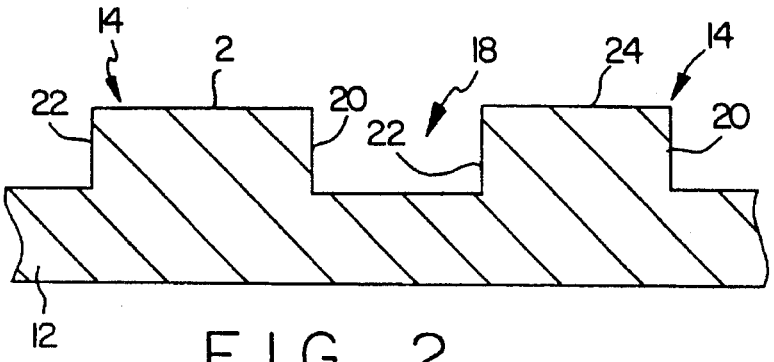
FIG. 2 is a fragmentary vertical cross-sectional view of the structure shown in FIG. 1 along line II—II of FIG. 1.

Segment 10 discloses an arcuate segment not made according to the present invention but it is important to the further understanding of the invention. FIG. 2 shows generally in vertical cross-section how plate segment 10 would appear. Note that bars 14 are provided with vertically upwardly facing surfaces 20 and 22 joined by a top surface 24 which is generally parallel to the plane of the segment base 12.

Figure 3:
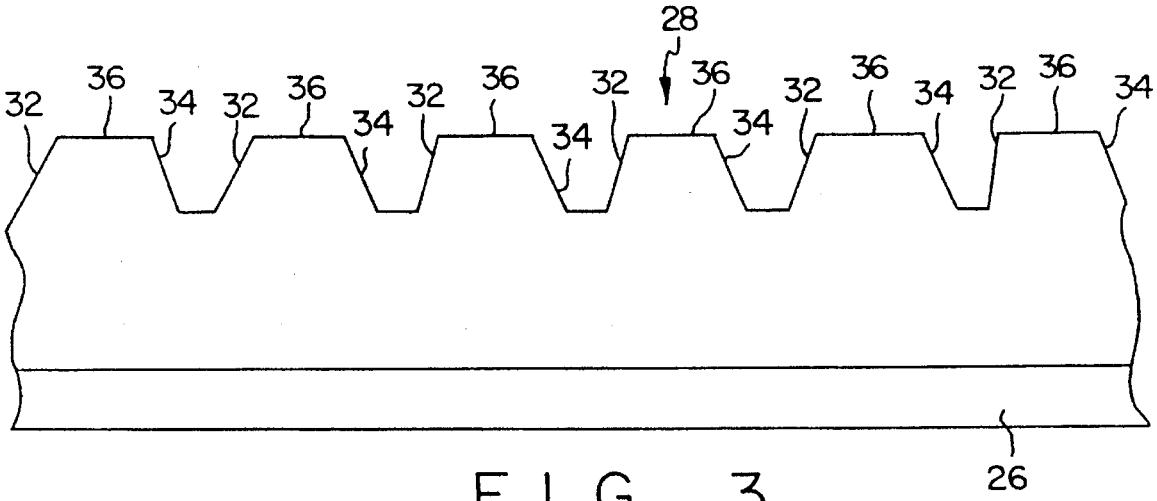
FIG. 3 is a fragmentary vertical cross-sectional view through a cope of drag portion of a mold, showing a portion of the pattern surface of a refiner plate or plate segment cutter bar illustrating the surface to be treated.

It is desirable as previously stated herein to temporarily hold the pulp slurry wood fibres within the grooves 18 for the purposes of further refining them as to size. FIG. 3 discloses a mold cope or a drag 26 into which the pattern 28 of a segment 10 has been placed. It would be the usual case that a pattern for a segment would be placed in the mold cope or drag 26, then foundry sand or molding sand packed around the pattern to result in the sand in the shape to be poured.

In the present invention the ceramic abrasive material to be used are selected from a group including alumina, silica, zirconia, silicon carbide, tungsten carbide, vanadium carbide and niobium carbide and the selected ceramic material is then mixed with a phenolic urethane or similar binder system to cause grain bonding. This mixture is applied to the surfaces of pattern 28 numbered 32, 34 and 36 as shown in FIG. 3. The angularity of the particles 38 (FIG. 4) is such that tight compaction can not take place and therefore spaces exist between the particles 38. The abrasive thus formed is then backed up with a molding sand mixture of silica sand, iron oxide, binder and other possible additives not essential to this explanation. Once the sand is cured it is separated from the pattern and the abrasive material 38 is exposed.

The selected abrasive particles 38 are in combination with the silica sand in a ratio of 20 to 80 percent by weight of the mixture.

The binder above referred to is in the dry state in the range of 0.5 to 5.0 percent by weight of the mixture.

The next step is to pour into the mold a superheated, molten metal, which may be of any ferrous composition, but in refiner plates usually a high carbon, chromium material. By superheating is meant to heat to a temperature greater than the temperature required to melt the metal. The superheated metal penetrates into the voids between the ceramic abrasive materials causing adhesion. The heat also fluxes a certain portion of the ceramic material to further strengthen the bond of abrasive material to the metallic matrix. A reference to FIG. 4 of the drawings will assist in the understanding of this latter explanation.

It should also be understood that the size of the ceramic particles 38 in the binder system may be preselected and may be varied by having several binders mixed with various sized particles and selectively applied as desired to surfaces 32, 34 and 36.

As the refiner plate segment 10 wears the base material wears down but the ceramic abrasive 38 remains in place because it is permanently attached to the surface of the grooves 18. Other surfaces may be machine finished or left as is.

I claim:

1. A method of integrally applying an abrasive rough surface to the grooves of refiner plates comprising the steps of:

a) placing a pattern for the desired shape of refiner plate bars and grooves into a mold;

b) mixing ceramic particles selected from a group consisting of alumina, silica, zirconia, silicon carbide, tungsten carbide, vanadium carbide and niobium carbide with silica sand;

c) adding a binder system selected from a group consisting of water/clay, liquid binder/liquid catalyst, liquid binder/gas catalyst and heat setting binders;

d) applying the mixture to the desired pattern surfaces;

e) surrounding and supporting the mixture with conventional molding sand;

f) separating the pattern and mold;

g) heating a base metal for said plate to a temperature greater than the melting point of said base metal; and h) pouring the molten metal into the mold.

2. The method as set forth in claim 1, wherein the ceramic particles and silica sand may have iron oxide and other additives added prior to adding the binder system.

3. The method as set forth in claim 1, wherein there is added the additional step of treating areas of the mold desired to be smooth with a coating consisting of a carrier comprising water or alcohol containing one or more powders such as titanium, boron, carbon, nanadium, chromium, niobium, tungsten, molybdenum or cobalt to produce a smoother surface after separating the pattern and mold.

4. The method as set forth in claim 1, wherein the silica sand is at ratio of 20 to 80 percent by weight relative to the ceramic particles.

5. The method as set forth in claim 1, wherein the abrasive is a combination of more than one kind of ceramic particles.

6. The method as set forth in claim 1, wherein the mixing of the silica sand and ceramic particles is for a period of one to five minutes to achieve even distribution.

7. The method as set forth in claim 2, wherein iron oxide and other additives are added to the silica sand and ceramic particles in a ratio of one-half percent to five percent by weight.

8. The method as set forth in claim 7, wherein the mixing of the silica sand, ceramic particles, iron oxide and other additives extends for a period of one to five minutes to achieve even distribution.

* * * * *